United States Patent [19]

Woodings et al.

[11] Patent Number: 5,069,430

[45] Date of Patent: Dec. 3, 1991

[54] BLAST FURNACE TAP HOLE DRILL WITH CENTRALIZING DRILL ROD SUPPORT

[75] Inventors: Robert T. Woodings, Pittsburgh; Ronald J. Mathews, Valencia, both of Pa.

[73] Assignee: Woodings Industrial Corporation, Mars, Pa.

[21] Appl. No.: 603,603

[22] Filed: Oct. 26, 1990

[51] Int. Cl.[5] ..... C21C 5/48

[52] U.S. Cl. ..... 266/271; 266/45

[58] Field of Search ..... 266/45, 271, 272

[56] References Cited

U.S. PATENT DOCUMENTS

| | | | |
|---|---|---|---|
| 3,507,484 | 4/1970 | Honda | 266/271 |
| 4,335,265 | 6/1982 | Roberge et al. | 266/271 |
| 4,418,894 | 12/1983 | Mailliet | 266/271 |
| 4,431,171 | 2/1984 | Foster | 266/271 |
| 4,602,770 | 7/1986 | Mailliet et al. | 266/45 |
| 4,893,794 | 1/1990 | Mailliet et al. | 266/271 |

*Primary Examiner*—S. Kastler

*Attorney, Agent, or Firm*—Forest C. Sexton

[57] ABSTRACT

A blast furnace tap hole drill is provided having an elongated feedshell which supports a percussion drill, drill rod assembly, and a centralizing drill rod support disposed between the percussion drill and a stationary forward end drill rod support, and a drive means for advancing the percussion drill and centralizing drill rod support in unison along the length of the feedshell such that the advancing motion of the centralizing drill rod support ceases as it nears the forward drill rod support without stopping the advancing motion of the percussion drill.

10 Claims, 3 Drawing Sheets

BLAST FURNACE TAP HOLE DRILL WITH CENTRALIZING DRILL ROD SUPPORT

BACKGROUND OF THE INVENTION

1. Field of the Invention

The present invention relates to the art of opening blast furnace tap holes and to blast furnace tap hole drills, and more particularly to a new and improved blast furnace tap hole drill having a movable support means for supporting the drill rod between the movable percussion drill mechanism and the rod support at the forward end of the feed shell to thereby permit the use of multiple drill rod components.

2. Summary of the Prior Art

It is well known that the hearth of an iron blast furnace is provided with a tap hole, commonly referred to as a "iron notch", through which molten iron, usually referred to as "hot metal", is drawn off at periodic intervals during the blast furnace campaign. During a normal campaign, such tapping must be done on an average of five to twelve times daily as the blast furnace hearth becomes filled with molten iron and slag. After the blast furnace has been tapped; i.e., the molten hot metal and slag drained therefrom, the tap hole or iron notch is plugged with clay or "mud" which will harden and seal the tap hole until the next time the blast furnace is tapped.

In accordance with usual practices, a special drill is utilized to open a tap hole; i.e., drill a passageway through the hardened clay plugging the iron notch for the purposes of tapping the blast furnace. Such blast furnace tap hole drills are normally pneumatically or hydraulically operated rotary percussion drills comparable to the rock drills utilized in the mining industry. Such drills impart both a rotary and an impact force on an elongated drill rod having a rock drill bit at the end towards the iron notch.

The base support for the blast furnace tap hole drill is normally secured to the floor, a structural column, or some solid base structure and is provided with suitable linkage members and remote controls so that the blast furnace tap hole drill can be remotely operated from a safe distance away. Pursuant to such remote operation, the tap hole drill is operated to move the drill into the proper position for drilling the tap hole, then operated to drill the tap hole, and thereafter moved back away from the tap hole and heat of the emerging hot metal, where the drill can be serviced and prepared for the next tap.

To prepare the blast furnace tap hole drill for each succeeding tap, it is always necessary to replace the drill bit, if not the drill rod or a portion thereof. This is because the temperature of the blast furnace hot metal, being about 2700°-2800° F., severely erodes the drill bit after it drills through the clay plug and enters the bath of molten hot metal. In addition, once the tap hole is drilled the ferrostatic head of hot metal within the blast furnace will cause the hot metal to emerge through the tap hole around the drill bit and drill rod before the drill rod and bit can be withdrawn from the tap hole. Often times, the drill bit will not only be severely eroded but the portion remaining will virtually be "welded" to the end of the drill rod to which it had previously been removably attached. In such an event, it will be impossible to remove the drill bit from the drill rod to replace a new drill bit, and accordingly it then becomes necessary to replace the entire drill bit and adjoining drill rod or drill rod component to which it is welded.

To reduce the expense of replacing the entire drill rod and bit assembly, it has become common practice to utilize a drill rod extension, which is merely a removable end portion of the drill rod, typically from 18 to 30 inches in length, fitted between the elongated rearward portion of the drill rod and the drill bit. Therefore, when the drill bit becomes welded to the drill rod extension bar, or the extension bar otherwise damaged, the extension bar can be replaced without the need for replacing the entire drill rod assembly. Since the entire drill rod assembly is normally 11 to 15 feet in length, it is clear that replacement of an 18 to 30 inch extension bar is significantly less costly than replacement of a 11 to 15 foot drill rod. It often happens, however, that even the drill rod is damaged by the heat of the operation and in need of replacement. Since any damage to the drill rod is normally relatively close to the end attached to the extension bar, it is obvious that if the drill rod were to comprise two or more replaceable lengths, in addition to the extension bar, that additional savings could be achieved by merely replacing the forward portion of the drill rod.

Because of the exceptional length of the drill rod assembly, however, it has not been possible to utilize interconnections which are spaced significantly from one or the other of the supported ends. Specifically, if a conventional drill rod were to comprise two rods joined together at or near the mid-length, or even more than say 40 inches from an end support, the rotary and impacting forces acting thereon would tend to cause the rod to buckle at the interconnection and cause the drill bit to advance at an angle deviated from the drill angle intended. Such a deviated drill angle can cause damage to the iron notch as well as other complications in the tapping procedure which can not be tolerated. In fact, it is because of this buckling phenomenon that it is necessary to limit the length of the extension bar to no more than about 30 inches. If longer extension bars are utilized, the tendency for the drill rod assembly to buckle at the coupling interface becomes rather significant.

It has been appreciated that if the drill rod could be supported at or near the mid-length, that the tendency to buckle would be so significantly minimized, that the drill angle would not be adversely affected. However, most tapping procedures require that the percussion drill advance the drill bit by an amount almost equal to the length of the drill rod assembly. Therefore, the percussion drill advances throughout most of the length of the feedshell upon which it is advancing, brings it quite close to the forward rod support, and hence there is no place on the feedshell upon which a mid-length support can be positioned without it restricting the advancing motion of the percussion drill.

SUMMARY OF THE INVENTION

This invention is predicated upon the conception and development of a unique centralizing drill rod support which is mounted to the feedshell and designed for limited advancement in unison with the advancing motion of the percussion drill so that it will support the drill rod at some point between the percussion drill and forward support no matter to what position the percussion drill has advanced. Pursuant to the limited advancement, the forward motion of the centralizing drill rod support ceases as it approaches close to the stationary forward drill rod support without interfering with the forward motion of the percussion drill. Because of this self-centering support between the percussion drill and the forward support, it thereby becomes possible to provide a two piece drill rod with an interconnection at or near the moving support because the centralizing drill rod support will significantly minimize any tendency of the drill rod to buckle at the interconnection. As a result of the use of the centralizing drill rod support and a two piece drill rod, only the forward portion of the drill rod will occasionally need replacement, and accordingly considerable cost savings can be achieved in maintenance of the blast furnace tap hole drill.

In addition to the above advantages, the centralizing drill rod support of this invention, by virtue of the added support, will also permit the use of smaller diameter drill rods. That is to say, because of the considerable length between the percussion drill and front support in prior art blast furnace tap hole drills, is had been necessary to provide drill rods of considerable diameter to avoid any sagging or whipping action which could cause the equipment to drill a tap hole deviated from a straight and true hole as intended. In supporting the drill rod between the percussion drill and front support, the centralizing rod support of this invention will also serve to prevent any sagging or whipping action, to thereby permit the use of smaller diameter drill rods, to further reduce the over-all cost of the operation.

DETAILED DESCRIPTION OF THE INVENTION

Figure 1:
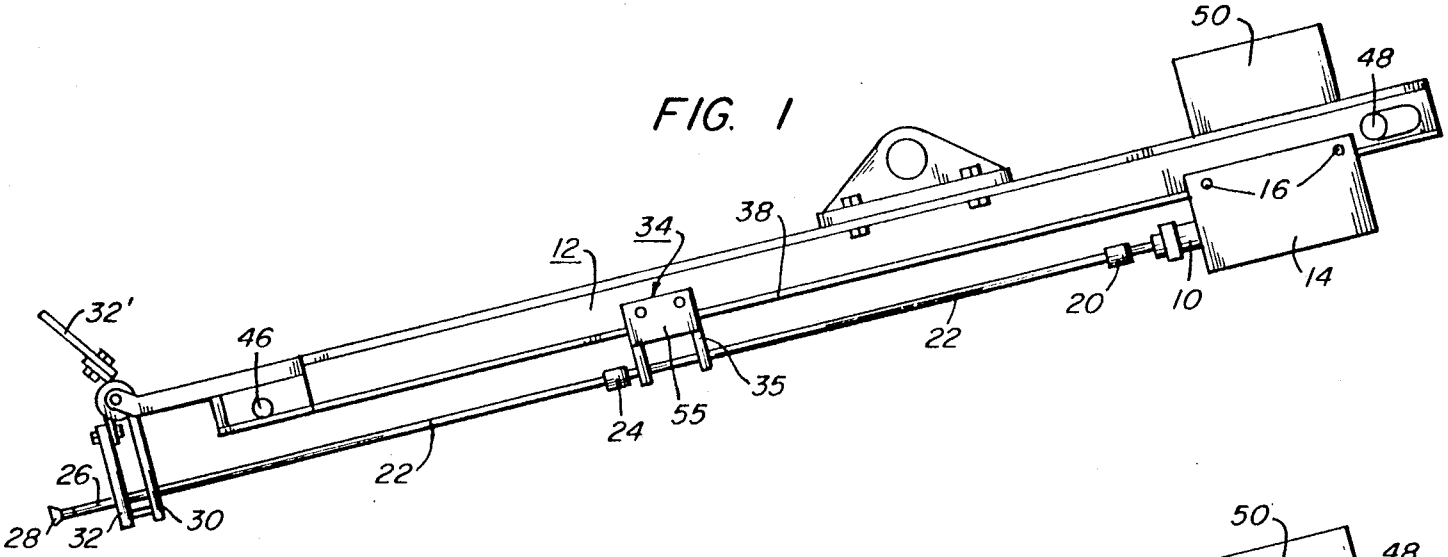
FIG. 1 is a partial elevational view of a blast furnace tap hole drill in accordance with this invention, illustrating the feedshell assembly, percussion drill, drill rod assembly, and the centralizing drill rod support as positioned prior to drilling a tap hole.
Figure 2:
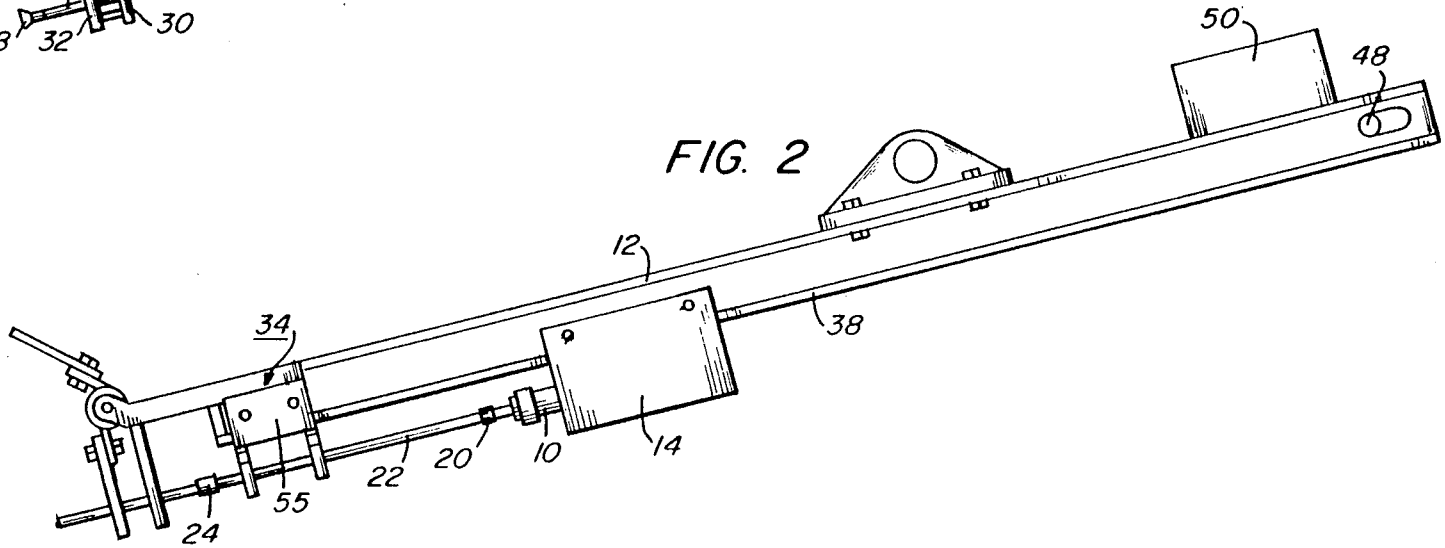
FIG. 2 is identical to FIG. 1 except that it shows the relative positions of the same components at or near the most advanced position of the percussion drill as representative of the position where the drilling operation is concluded.

Reference to FIG. 1 will illustrate one embodiment of this invention in combination with a typical blast furnace tap hole drill feedshell and comprises a percussion drill 10 rollably or slidably mounted to the feedshell 12. As shown, the percussion drill 10 is shrouded by a U-shaped protective steel plate 14 through which wheel axles 16 are mounted to thereby permit percussion drill 10 to move along the feedshell by virtue of wheels (not shown) rolling on the upper surface of the lower flanges 38. A drill rod assembly is connected to the rotary tip of percussion drill 10 via coupling 20. As further shown in FIG. 1, the drill rod assembly comprised a drill rod 22 having a forward and rearward section joined together by coupling 24, extension bar 26, and drill bit 28. Accordingly, the rearward end of the drill rod assembly is supported by percussion drill 10 at coupling 20, while the forward end is supported by support plate 30 rigidly secured to the forward end of feedshell 12. Also show in FIG. 1 is a splash plate 32 which is designed to shield rod support 30 from the blast furnace hot metal. Typically, a quick change splash plate 32' is also provided.

But for the forward and rearward supports 30 and 20 described above, blast furnace tap hole drills of the prior art have not provided any other support for drill rod assembly. Pursuant to this invention, however, a centralizing drill rod support 34 is provided between support plate 30 and coupling 20, which is supported by the adjacent percussion drill 10.

As shown in FIGS. 1-5, the feedshell 12 is normally a fabricated structure comprising primarily two fabricated steel channels 36 (FIG. 3), each having a lower flanges 38. Channels 36 are rigidly secured together with a space between the two flat back sides 40. An endless drive chain 42 is mounted between the two steel channels 36 for rotation about a forward sprocket wheel 44 (FIG. 5) and a rearward sprocket wheel (not shown). While the sprocket wheels are not visible in FIGS. 1 and 2, forward and rear sprocket wheel axles 46 and 48 respectively are visible. As previously noted, percussion drill 10 is mounted onto steel channels 36 for rolling or sliding motion along the bottom surface thereof. Percussion drill 10 is also rigidly secured to one or more drive chain links (not shown) so that the percussion drill 10 can be advanced and retracted along feedshell 12 by proper activation of drive chain 42. Therefore, a drive means 50, such as a reversible hydraulic motor, is mounted on feedshell 12 to drive the drive chain 42 in either direction, and thereby drive the percussion drill 10 forward or backward along feedshell 12 as necessary to drill a tap hole and retract the drill bit when the tap hole has been drilled.

Figure 3:
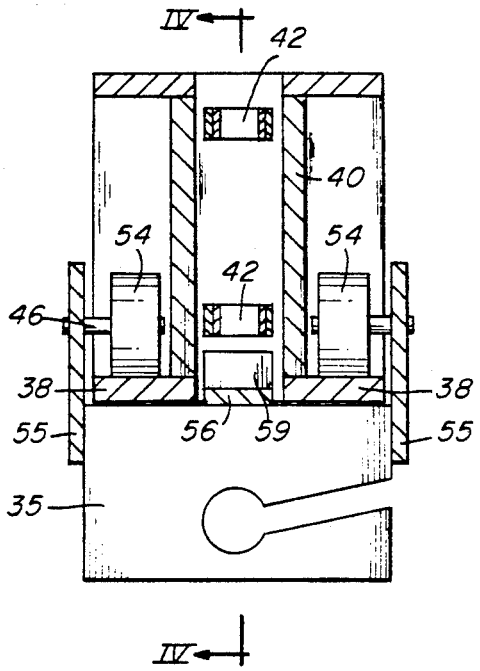
FIG. 3 is a cross-sectional end view of the feedshell through the mid-portion of the centralizing drill rod support rollably secured thereto, with the section taken at line III—III of FIG. 4.
Figure 4:
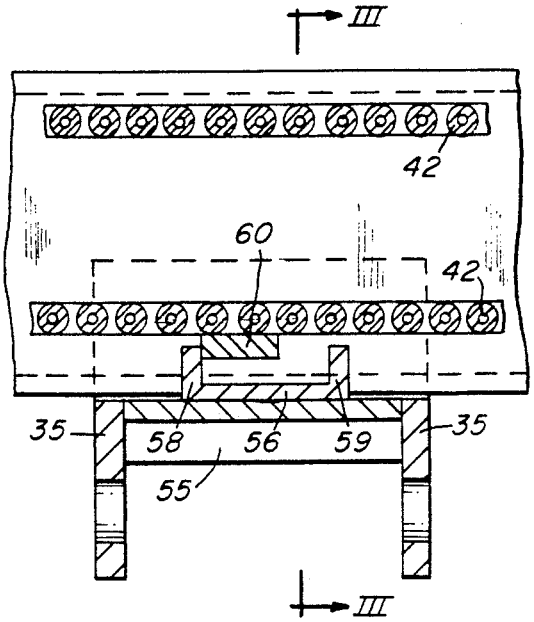
FIG. 4 is a partial cross-sectional side view of the feedshell and centralizing drill rod support in a rearward position as representative of its position in FIG. 1, with the section taken at line IV—IV of FIG. 3.
Figure 5:
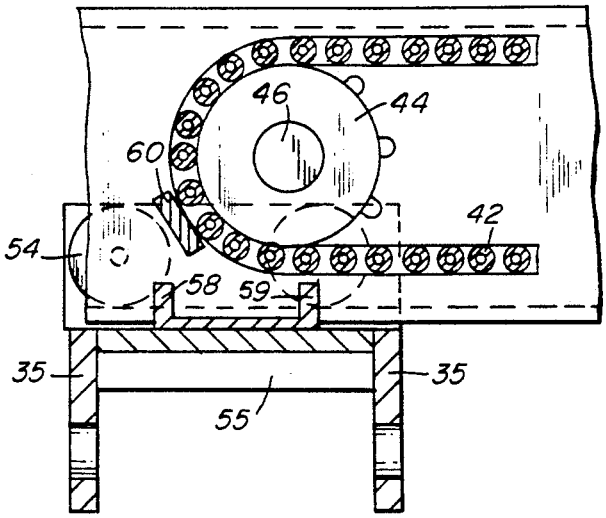
FIG. 5 is substantially identical to FIG. 4 except that the centralizing drill rod support is shown at its most advanced position after the drive bar has released engagement therewith as representative of its position in FIG. 2.

The crux of this invention resides in the centralizing drill rod support 34, which like percussion drill 10, is mounted to feedshell 12 for sliding or rolling motion along the lower surfaces of steel channels 38. As shown, the drill rod support is provided by a paid of vertical plates 35, each of which is provided with a slotted hole within which the drill rod 22 rests. While two such vertical plates 35 are utilized in the embodiment illustrated, it should be apparent that one such plate, or more than two, or even an elongated body, would be adequate for the purposes of this invention. As shown in FIG. 3, inwardly facing wheels 54, rotatably secured to wheel support plate 55, are provided on the upper side of the centralizing drill rod support 34 for rolling along the flanges 38 of steel channels 36, in much the same fashion as the percussion drill is mounted for rolling motion. Unlike percussion drill 10, however, centralizing drill rod support 34 is not rigidly secured to drive chain 42. Instead, the upper surface of centralizing drill rod support 34 is provided with a small channel section 56 with a forward flange 58 and a rearward flange 59 extending upwardly transverse to the direction of drive chain motion, but not in contact with the drive chain 42. A push bar 60 is rigidly secured across the lower side of a pair of chain links (FIG. 4) which, when the percussion drill is retracted, is adapted to be positioned between the two flanges 58 and 59 on channel section 56. Accordingly, when the lower expanse of drive chain 42 is moving in a forward direction and advancing percussion drill 10 in a forward direction, push bar 60 will be biased against the forward flange 58 of channel section 56 and therefore, also advance centralizing drill rod support 34 in unison with advancing percussion drill 10. Therefore, centralizing drill rod support 34 will initially be advanced forwardly by the same degree as percussion drill 10. It should be noted, however, that when push bar 60 reaches forward sprocket wheel 44, it will rotate around the sprocket wheel 44 so that it is no longer in engagement with, and can no longer push against, forward flange 58. At that point, therefore, the forward motion of centralizing drill rod support 34 will stop while percussion drill 10, on the other hand, continues to advance.

After the tap hole has been drilled and the motion of drive chain 42 reversed for the purpose of retracting the percussion drill to withdraw the drill bit 28 from the blast furnace, push bar 60 will rotate around sprocket wheel 44 in the reverse direction. When push bar 60 reaches the lower horizontal expanse of the chain drive, it will engage and push against rear flange 59 on channel section 56, to thereafter retract centralizing drill rod support 34 in unison with retracting percussion drill 10.

In view of the above description, it should be apparent that in the starting position, centralizing drill rod support 34 is generally mid-way between the two drill rod end supports 30 and 20 of the drill rod assembly. As percussion drill 10 advances during a drilling operation, centralizing drill rod support 34 will advance in unison therewith so that the space between centralizing drill rod support 34 and forward support 30 progressively decreases, while the space between centralizing drill rod support 34 and rearward support 20 remains constant. When centralizing drill rod support 34 reaches a point under sprocket wheel 44, however, its forward advance stops so that the distance between centralizing drill rod support 34 and forward support 30 remains constant while the distance between centralizing drill rod support 34 and rearward support 20, afforded by percussion drill 10, progressively diminishes. Therefore, while centralizing drill rod support 34 is not at all times equally spaced between the two end supports 20 and 30, it does maintain a significant degree of centralizing drill rod support between the two end supports 20 and 30 so that it will support the mid-section of drill rod 22 to prevent any significant degree of buckling, even when the drill rod comprised two components joined together at or near the mid-length.

Figure 6:
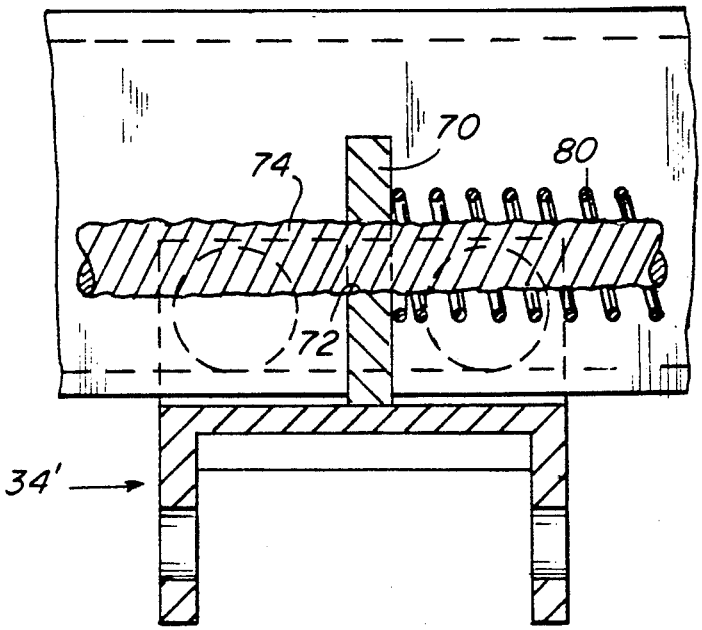
FIG. 6, is a cross-sectional side view comparable to FIG. 4 but illustrating a different embodiment based on a different drive means, illustrating the centralizing drill rod support as it would appear at its starting position.
Figure 7:
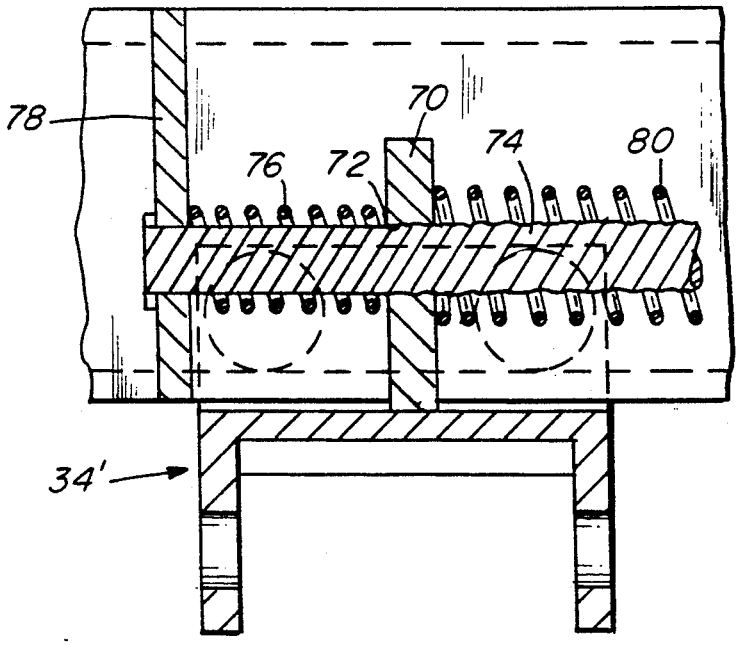
FIG. 7 is substantially the same as FIG. 6 except that the centralizing drill rod support is shown at its most advanced position after the drive means has released engagement therewith.

In view of the detailed embodiment of this invention as described above, it should be apparent that numerous other embodiments, variations, and modifications could be incorporated without departing from the spirit of the invention. While a specific mechanism design has been shown for pushing and releasing, and reengaging and pulling the centralizing drill rod support, it is apparent that other designs and embodiments could be utilized, and may in fact have to be utilized with differing blast furnace tap hole drill designs. For example, a drive means other than a drive chain will of course necessitate a modification based on whatever drive means is utilized. If the drive means were a worm gear, for example, the same principle could be utilized if a means were provided at the forward end of the worm gear for disengaging and releasing the centralizing drill rod support from the drive means to limit its forward motion without limiting the forward motion of the percussion drill. FIGS. 6 and 7 are illustrative of such an embodiment where a worm gear is utilized as the drive means to advance both the percussion drill (not shown) and centralizing drill rod support 34'. In this embodiment, centralizing drill rod support 34' is provided with a single plate 70 extending upwardly transverse to the axis of worm gear 74, and having a geared hole 72 therethrough which mates with the gears of worm gear 74. Accordingly, rotation of worm gear 74 will advance the centralizing drill rod support 34' in unison with the advancing percussion drill. When plate 70 reaches a point where the gearing in hole 72 disengages from the gearing of the worm gear 74, as depicted in FIG. 7, its further advance will be stopped by a first compression spring 76 which will be biased between a front plate 78 and plate 70 on centralizing drill rod support 34', as a second compression spring 80, extending between plate 70 and the percussion drill, is progressively compressed until such time as the forward motion of the percussion drill is stopped. Upon reverse rotation of worm gear 74, second compression spring 80 will prevent plate 70 from being threaded onto worm gear 74 until such time second compression spring 80 is fully extended. At that point, first compression spring 76 will bias plate 70 sufficiently against the gearing on worm gear 74 to cause centralizing drill rod support to be re-threaded thereto and retracted by the worm gear 74. Obviously, the biasing forces of second compression spring 80 must be sufficiently greater than those of first compression spring 76 to prevent premature retraction of centralizing drill rod support 34'.

In addition to the above modified embodiments, it should be appreciated that the essential feature of the invention is that the centralizing drill rod support be advanced during a drilling operation as described to prevent it from limiting the advancing motion of the percussion drill while maintaining a support between percussion drill and the forward drill rod support. The advantage to be gained, of course, is to prevent any tendency for the drill rod to buckle during the drilling operation, particularly if a two piece drill rod, or a smaller diameter drill rod are used. Therefore, the supporting feature is not essential after the tap hole has been drilled or during the reverse, withdrawal operation. Therefore, the centralizing drill rod support could be returned manually after withdrawal of the percussion drill if desired. In the first above-described embodiment, this could be done by eliminating rear flange 59 from centralizing drill rod support 34. In the second above-described embodiment, this could be done by eliminating at least the first compression spring 76. In either event, the centralizing drill rod support would not be returned to its original starting position in unison with return of the percussion drill 10, but could be returned manually merely by rearwardly hand pushing the centralizing drill rod support to its starting position. While such a manual return could prolong the time necessary to recondition the drill, such a practice may be desirable to some operators in facilitating installation of new drill rod components. Indeed, it would require very little effort to manually return the centralizing drill rod support to its starting position.

It should be further appreciated that the apparatus of this invention could even be incorporated into drill assemblies other than blast furnace tap hole drill, such as rock drill; for example, for purposes of achieving comparable benefits. Since conventional rock drill rods are not subject to frequent damage as a result of exposure to molten hot metal, however, there would be less benefit in using drill rod in multiple sections or thinner diameters. The primary advantage of this invention, therefore, is appreciated primarily with regard to blast furnace tap hole drills.

What is claimed is:

1. A drill assembly comprising an elongated feedshell supporting a percussion drill and an elongated drill rod assembly attached to the percussion drill, whereby said feedshell supports said drill rod assembly at a forward support disposed away from the drill rod, a centralizing drill rod support attached to said feedshell between said forward support and said percussion drill, a drive means for advancing said percussion drill and said centralizing drill rod support along the length of said feedshell as necessary to perform a drilling operation, release means for releasing said centralizing drill rod support from said drive means when said centralizing drill rod support nears said forward drill rod support to stop its forward motion without stopping the forward motion of said percussion drill.

2. A drill assembly according to claim 1 in which said drive means both advances and retracts said percussion drill and said centralizing drill rod support.

3. A drill assembly according to claim 1 in which said drive means comprises a continuous drive chain rotatable about a forward sprocket wheel, said percussion drill attached to said drive chain, and said release means comprises a push means attached to said drive chain adapted to engage and push said centralizing drill rod support until said push means revolves about said forward sprocket wheel.

4. A drill assembly according to claim 3 in which said drive chain is reversible and adapted to return said percussion drill and said centralizing drill rod support to a starting position.

5. A drill assembly according to claim 4 in which said push means is adapted to re-engage and push said centralizing drill rod support upon reverse activation.

6. A drill assembly according to claim 1 in which said drive means comprises a worm gear rotatably geared to said percussion drill and said centralizing drill rod support, and said release means comprises an ungeared portion of said worm gear at the forward end thereof adapted to unthread itself from said centralizing drill rod support to stop its forward motion without stopping the forward motion of said percussion drill.

7. A drill assembly according to claim 6 in which said worm gear is reversible and adapted to return said percussion drill and said centralizing drill rod support to a starting position.

8. A drill rod assembly according to claim 1 wherein said drill rod assembly is a blast furnace tap hole drill.

9. A blast furnace tap hole drill comprising an elongated feedshell supporting a percussion drill and an elongated drill rod assembly attached to said percussion drill, support means attached to said feedshell adapted to support said drill rod assembly at a position disposed away from said percussion drill, a centralizing drill rod support attached to said feedshell between said support means and said percussion drill, a drive chain rotatable about a forward sprocket wheel for advancing and retracting said percussion drill along the length of said feedshell as necessary to perform a drilling operation, push means on said drive chain for engaging and pushing said centralizing drill rod support to advance said centralizing drill rod support in unison with said percussion drill until said push means revolves about said sprocket wheel and thereby ceases to push said centralizing drill rod support to stop its advancing motion without stopping the advancing motion of said percussion drill.

10. A blast furnace tap hole drill according to claim 9 in which said push means is adapted to re-engage said centralizing drill rod support when it is activated in the reverse direction to thereby return both the percussion drill and centralizing drill rod support to a starting position.

* * * * *